United States Patent [19]

Pauliukonis

[11] 4,076,465

[45] Feb. 28, 1978

[54] VOLUMETRIC PROPORTIONING DILUTER

[76] Inventor: Richard S. Pauliukonis, 6660 Greenbriar Drive, Cleveland, Ohio 44130

[21] Appl. No.: 639,898

[22] Filed: Dec. 11, 1975

Related U.S. Application Data

[63] Continuation-in-part of Ser. No. 434,568, Jan. 18, 1974, Pat. No. 3,940,937.

[51] Int. Cl.[2] ..... F01B 7/20; F04B 35/00; F15B 15/17; F15B 15/24

[52] U.S. Cl. ..... 417/339; 417/393; 92/13.3

[58] Field of Search ..... 417/398–404, 417/521, 339, 343, 393; 91/173, 321; 92/13.6, 13.3

[56] References Cited

U.S. PATENT DOCUMENTS

| | | | |
|---|---|---|---|
| Re. 25,873 | 10/1965 | Rutherford | 92/13.6 |
| 928,819 | 7/1909 | Swanson | 417/521 |
| 1,353,216 | 9/1920 | Carlson | 417/401 |
| 2,024,787 | 12/1935 | Freloar | 417/493 |
| 2,142,329 | 1/1939 | Nika et al. | 417/401 |
| 2,255,359 | 9/1941 | Lepersonne | 92/84 |
| 2,300,110 | 10/1942 | De Hoog | 222/309 |
| 2,463,062 | 3/1949 | Seppmann | 92/107 |
| 2,566,436 | 9/1951 | Waite | 417/521 |
| 2,576,747 | 11/1951 | Bryant | 92/13.6 |
| 2,664,859 | 1/1954 | Green | 92/108 |
| 3,021,890 | 2/1962 | Donini | 92/13.6 |
| 3,139,156 | 6/1964 | Urso | 417/521 |
| 3,205,825 | 9/1965 | Kojabashian et al. | 91/321 |
| 3,362,618 | 1/1968 | Fortinov | 417/401 |
| 3,426,649 | 2/1969 | Roppers | 91/173 |
| 3,768,932 | 10/1973 | Olomouc | 417/393 |

FOREIGN PATENT DOCUMENTS

| | | | |
|---|---|---|---|
| 426,693 | 7/1934 | United Kingdom | 417/341 |

*Primary Examiner*—William L. Freeh

[57] ABSTRACT

A reciprocating device for proportionating volumes of two distinct and different fluids within the same housing by a simultaneous fluid drawing from a supply source into the separate compartments provided inside an elongated housing of differential diameters having separating seals incorporated therein and receiving slideably different diameter pistons of elongated close sliding fit, comprising separate chambers suitable for fluid separation and holding therein at the end of a first suction cycle and subsequently by a simultaneous fluid discharge from the separate chambers for mixing with resultant dilution thereof during a second exhaust cycle, to provide simple and accurate proportioning-diluter adaptable for use in applications handling highly concentrated chemicals in a solution form subject to a precise dilution in fixed measured displacements per each stroke, including various means of diluter operation from manual to automatic unit operation by the use of pressurized fluids such as pressurized air or even city water under pressure in a system incorporating volume adjustment of ratio diluent vs. concentrate discharged when controlled by appropriate three way valve-operator in the actuating end of the diluter while in the discharge end-by check valves.

7 Claims, 2 Drawing Figures

VOLUMETRIC PROPORTIONING DILUTER

This is a continuation in part of my intensifier application Ser. No. 434,568 filed Jan. 18, 1974 and now allowed to issue as a U.S. Pat. No. 3,940,937.

This invention is particularly suitable for mixing and diluting two separately housed fluids of different concentration to result in a solution of a specific order dictated by a process such as found in Chemical, Pharmaceutical, Medical, Food, Drug, Cosmetics, Petroleum, Biochemical, Dispensing, Packaging, Bottling, Vending industries, but most important, in automation, miniaturization and instrumentation fields.

There is a great demand for simple diluters, presently being custom made to suit individual application by aggregation of individual elements, pointing to the fact that at present there is no such proportioning diluter on the market that could serve industtry cited, except for imports and those predominantly slated toward clinical laboratories which more ofter employ samples of a few lambdas in volume as concentrate subject to a dilution in ratios 1000:1 or more. It is not to say that such ratios are hard to attain. On the contrary, the diluter of this invention has no limitation as to the ratio of the concentrate vs. diluent, but the basic design here is not directed to microquantities per se, and intended to serve small quantities as well as large quantities found in majority of process industries, presently not provided with proper diluting or mixing equipment, although not limited to it.

The object of this invention is to provide a simple diluter through a modification of said intensifier design comprising the fundamental parts of such diluter. Devices of this type that improve the state of the art of diluters are obviously needed.

Other objects reside in the novel details of construction and combination and/or arrangment of parts, all of which will be apparent from the description that follows.

Figure 2:
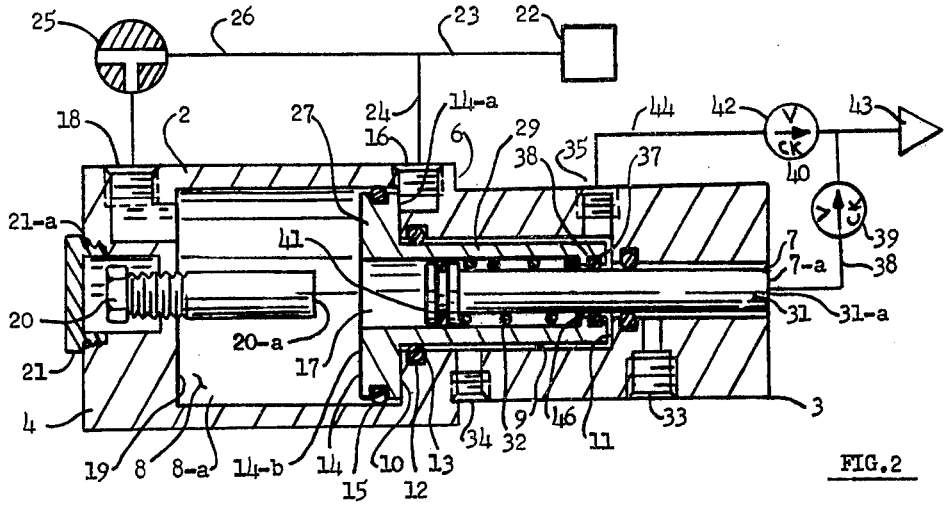
FIG. 2 is a cross-sectional view of diluter shown in FIG. 1 at the end of the discharge cycle when pistons are actuated to assume closed second position, and the three-way valve is set to allow a supply of the working fluid from a source to an actuating end.
Figure 1:
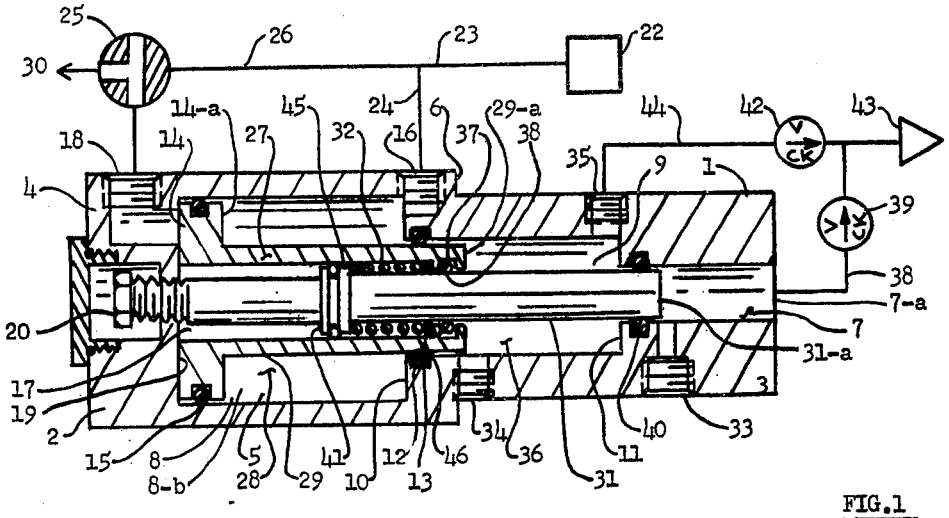
FIG. 1 is a cross-sectional view of a proportioning diluter operated by a three-way valve that conveniently unloads a working fluid to maintain diluter chambers in a normally open first position at the end of the suction cycle.

As can be seen from the drawings, a volumetric proportioning diluter 1 includes a housing 2 which has a smaller diameter pumping end 3 at one housing end and a larger diameter actuating end 4 at the other housing end, interconnected by a shoulder 6 approximately midway thereof, including a differential diameter bore 5 passing therethrough of which a first small diameter bore portion 7 continues inwardly therefrom partway toward the actuating end and a second large diameter bore portion 8 starts at the actuating end to continue inwardly toward the pumping end including an intermediate diameter bore portion 9, more clearly visible in FIG. 1, with innermost ends connecting both the bore portion 8 through a shoulder 10 and the bore portion 7 through a shoulder 11. Inside the bore portion 9, adjacent shoulder 10 there is a radial groove 12 with seal 13 to in effect separate the actuating housing end 4 from the pumping end 3, in case the actuation of this diluter is done manually, dispensing with end 4 fully. Presently shown actuating end 4 includes a slidably received piston assembly 27 with an actuating large diameter piston 14 and a seal 15 of sliding fit inside large diameter bore portion 8 to move when actuated by pressure entering and leaving actuating end 4 via first port 16 delivering working fluid first to a piston side **14-*a*, clearly visible in FIG. 1, which is smaller in cross sectional area as opposed to larger side 14-*b* clearly visible in FIG. 2 which also shows piston face 14*b* counterbored inwardly by a coaxial bore 17 and together pressurized by actuating fluid delivered from a source 22 through conduits 23, 26 and valve 25 via second port 18 to exert an end force larger than the opposing end force piston side 14-*a* experiences. Seal 15 of piston 14 moving inside portion 8 in effect divides the bore portion 8 into a first blind portion section 8-*a* which is closed by an end wall 19 provided with centrally situated adjusting means comprising a stroke adjusting stud 20 protruding inwardly thereto and an end cap 21 with appropriate seal 21-*a* as shown in FIG. 2, and into a second constant pressure section 8-*b* which communicates with the actuating pressure source 22 housing either compressed air or supply of city water under pressure delivered to port 16 via conduits 23 and 24 to exert a constant force over piston side 14-*a* and to force piston 14 into the position of FIG. 1 automatically when valve 25 is closed, as shown in FIG. 1, creating an annulus 28 between bore portion 8 and a reduced diameter elongated piston section 29 of an outside diameter slightly smaller than the diameter of the intermediate diameter bore portion 9 to facilitate a closely received sliding fit therewith. FIG. 1 shows piston assembly 27 with piston head 14 abutting end wall 19 while the opposite end of elongated piston section 29 is engaged inside said bore portion 9 provided with seal 13 identifying the first normally open position of the pump. If this device were not actuated by a presurized fluid from the source 22 shown, there would be no need for piston seal 15, and in fact piston 14 could be converted to a palm button instead. In such a case a normal position of this device would more likely be that as shown in FIG. 2 until piston assembly 27 is withdrawn manually into that shown in FIG. 1. The same would pertain if the actuation would in fact be motorized to provide a reciprocating action similar to that performed by hand. So, it is important to know that the positions shown in FIG. 1 and FIG. 2 are operator dependant. In the illustrated case where the operator in effect is pressurized fluid inside the actuating housing end 4, the normal position that the piston assembly 27 will assume therein is as shown in FIG. 1 when all conduits are connected to the source of supply 22 via ports 16 and 18 and valve 25 is open to exhaust, as shown by arrow 30 in FIG. 1, be it atmosphere or a drain. Consequently, the operation of this device hinges on valve 25 which opens first to allow the fluid enter the blind portion section 8-*a* via port 18 and act against piston face 14-*b* for counterforcing the constantly prevalent opposing force piston side 14-*a* experiences and thereby to shift piston assembly 27 until side 14-*a* abuts shoulder 10 at the end of piston stroke as shown in FIG. 2 comprising a second fluid discharge position inside the pumping end 3. Thereafter valve 25 must disconnect the supply of the working fluid from the source 22 by valve resetting to discharge position and fluid exhaust from section 8*a* as shown by arrow 30 for an automatic return of piston assembly 27 back into the normally occuring first fluid suction position inside the pumping end 3 shown in FIG. 1 due to the force piston side 14-*a* experiences when acted by the pressurized working fluid that enters section 8**-*b* via constantly open fluid port 16. The valve 25 by necessity must be of a three-way construction to facilitate the above discussed function representing rather simple means of diluter operation through pressurized actuation.

The pumping end 3 in fact is just as simple, except for the provision for volumetric adjustment which requires the use of a telescoping piston-rod assembly 45 backed up by a spring 32 both of which could be dispensed with if operation were manual and if the device did not provide volume adjustment. This may prevail in many applications with fixed displacement, and the device would function very well indeed if the piston assembly 27 were extended integrating the rod 31 of piston 41 of piston-rod assembly 47 shown. It must be emphasized however that the provision of field adjustment of volumes is important warranting cited additions of parts. This in essence is not complicated as will be seen from the description of the pumping end 3 represented by the intermediate diameter bore portion 9 having two side ports therein and by the first small diameter bore portion 7 having a side port 33 for supply of concentrate to be diluted by this device. A side port 34 entering bore portion 9 through the wall adjacent external housing shoulder 6 is provided therein for a supply of diluent thereto. A side port 35 entering bore portion 9 through the wall adjacent internal bore shoulder 11 is provided therein for diluent discharge in metered quantity per each stroke. A seal 40 inside a radial groove of the bore portion 7 adjacent shoulder 11 insures positively a separation of diluent accumulated inside an annular space 36 formed between rod 31 of piston 41 and the intermediate bore portion 9, also protected by a seal 37 inside internally machined radial groove 38 at the end of piston section 29, from the concentrated fluid entering bore portion 7 via side port 33 for a discharge therefrom through an opening 7-*a* which doubles also as a discharge port. The concentrate from the discharge port 7-*a* proceeds via conduit 47 provided with a directional check valve 39 to meet with diluent discharged from annulus 36 via side port 35 connected by conduit 44 also provided with a check valve 42 to subsequently discharge mixed into receiver 43 when piston 14 and piston 41 become pressurized by the working fluid entering the side port 18 and the pump assumes the second fluid discharge position of FIG. 2, while valve 25 is open to permit flow of the working fluid from the supply source 22 into the actuation section 8-*a*. When valve 25 becomes reset to a discharge position, the actuation section 8-*a* depressurizes and the piston assembly 27 together with piston-rod assembly 45 move back into the original first fluid suction position, the piston assembly 27 being shifted by pressure force over piston side 14-*a* discribed when analyzing means of actuation before, and the piston-rod assembly 45 being shifted by the spring 32 lodged between the piston 41 and a shoulder 46 adjacent seal 37 at the end of piston section 29 until piston 41 abuts a stud end 20-*a* of stud 20 controlling the stroke. In turn, ratios of diluent versus concentrate can be varied selectively by regulating the distance of the adjusting stud that protrudes inwardly for control of the stroke of the piston-rod assembly 45 when piston 41 is urged to return to the original position by spring 32 as shown in FIG. 1, with stud end 20-*a* in complete contact with piston 41. Since the relative motion axially of piston-rod assembly 45 is coupled with axial motion of piston assembly 27, there will be little if any spring resistance that the fluid force will have to overcome during the second fluid discharge position of FIG. 2 and the spring will be most effective during the automatic return to a given stroke during the first fluid suction position of FIG. 1, providing rather efficient unit operation. To note is the fact that because of a close sliding fit of piston portion 29 and of rod 31 in their respective bore portions 9 and 7, no check valves are contemplated for use in their respective fluid supply ports 34 and 33 due to cut-off principle which prevails when an end 29-*a* of the section 29 and an end 31-*a* of the rod 31 pass ports 34 and 33 respectively during the axial position change when pressurized at the actuating end 4 of the diluter, provided no variation in displacement is needed. Port 33 may be moved away from the position shown adjacent seal 40 toward the discharge port 7-*a* for adjustment of displacement by rod 31 moving inside bore portion 7. Port 33 will require incorporation of a check valve (not shown) therein to facilitate such volumetric control by position change of rod 31 inside the bore portion 7 as regulated by stroke controlling stud 20.

Having a fixed displacement from the annular space 36 occupied by diluent and an adjustable displacement from the bore portion 7 occupied by concentrate, ratios of volumetric displacement of diluted fluid, discharged mixed, can be varied ad infinitum. Check valves 42 and 39 may be integrated into the housing dispensing with conduits 44 and 47 respectively for unit simplification without departing from the scope and the spirit of this invention. The same pertains to the receiver 43 which may become incorporated into the housing to act as a single discharge port for fluids discharged therefrom diluted and mixed.

The invention is not restricted to the slavish imitation of each and every one of the details described above which have been set forth merely by way of example with the intent of most clearly setting forth the teachings of the invention. Obviously devices may be provided which change, eliminate or add certain specific structural details without departing from the invention.

For example, such an obvious modification would result if rod end 31-*a* and end 29-*a* of piston section 29 were provided with peripheral seals for handling gases with this device wherein the cut-off principle discussed would not adequately seal displacement pistons within respective bore portions thereof without departure from this invention.

What is claimed is:

1. A volumetric proportioning diluter comprising:

an elongated housing having first and second ends interconnected by a differential diameter bore passing therethrough, an elongated piston assembly having different diameters that correspond to the diameters of said differential diameter bore is slidably received therein, said piston assembly is movable inside said bore axially, a pump actuating means for moving said piston assembly in said first housing end separated from and adjacent pumping means for fluid discharge, said pumping means spaced along said housing length toward said second housing end including at least two completely separate fluid chambers adjacent each other and capable of receiving different fluids of distinctly different displacement volumes due to a difference in said piston diameters inside said differential diameter bore, fluid supply and discharge ports in said separate fluid chambers for fluid communication therewith, including directional control means in said fluid supply and discharge ports and a first directional control in said fluid supply ports of said chambers to allow fluid flow into said fluid chambers and not vice versa and a second directional control in said fluid discharge ports of said chambers to allow fluid discharge from said fluid chambers and not vice versa, individual fluid discharge conduit means connecting said discharge ports to a single conduit for fluid discharge therefrom, said pumping means including a volume displacement piston reciprocating in a chamber pumping concentrate and being carried by said elongated piston assembly for relative axial piston reciprocation therebetween, said displacement piston being slidable therein from a first fluid suction position when said pump actuating means urges said piston assembly to assume a first piston withdrawn position to a second fluid discharge position when said pump actuating means urges said piston assembly to assume a second piston engaged position, thereby providing a simultaneous fluid suction of different volumes into said fluid chambers via said fluid supply ports when said volume displacement piston is moved to said first fluid suction position, and when said volume displacement piston is moved to said second fluid discharge position, resulting in a simultaneous fluid discharge from said fluid chambers via said fluid discharge ports for a dilution thereof in the ratio of respective volumetric proportions of said fluid chambers when delivered via said individual conduits to discharge via said single conduit therefrom, including means for control of volumetric proportions.

2. A volumetric proportioning diluter as in claim 1 wherein said means for control includes stroke adjustment of said displacement piston within said chamber housing said concentrate while the volumetric displacement from said diluent chamber is fixed.

3. A diluter as in claim 1 wherein said actuating means are motorized to urge said differential piston position change with pumping.

4. A diluter as in claim 1 wherein said pump actuating and pumping means include a differential motor-pump piston in said elongated piston assembly wherein a first larger diameter differential motor piston incorporating a second coaxial smaller diameter pump piston which is carried by and relatively movable with respect to said first motor piston and limited during its stroke movement by a stop for said ratio control of said volumetric proportions of fluid discharged from said first and second chambers, said stop incorporated into a motor housing end so as to permit stop adjustment selectively in accordance with desired proportioning of fluids mixed.

5. A volumetric proportioning diluter as in claim 1 wherein said bore having a first large size actuating end with an end wall adjacent said first end extending a substantial portion inwardly therefrom toward said second end along the axis of said bore including a first shoulder therein, a second small size bore portion adjacent said second end extending inwardly therefrom toward said first end along the axis of said bore, a coaxial third intermediate size bore portion interconnecting the innermost ends of said first and second bores extending inwardly from said first shoulder toward said second bore including a second shoulder adjacent said second bore, said first large size actuating end having a diameter larger than the diameter of said second and third bores, serving as said pump actuating means of said diluter, an internal groove with a first seal in said third bore portion adjacent said first shoulder separating said second and third bore portions serving as said pump chamber means from said pump actuating means wherein said third bore portion having a diameter larger than said second small bore portion comprises said second diluent chamber including at least a pair of side ports of which a first side port adjacent said first shoulder serves as said supply port for diluent and a second side port adjacent said second shoulder serves as said discharge port for diluent, an integral groove with a second seal in said second small bore portion adjacent said second shoulder separating said second from said third bore portions defines said first concentrate chamber therein having at least a pair of ports of which a first side port entering bore portion through a wall serves as said supply port for concentrate, said second small bore portion end adjacent said second housing end comprising said second port for concentrate discharge, said pump actuating means with said elongated axially slidable piston assembly including a first large diameter short piston portion with peripheral seal of close sliding fit with said first large size actuating bore at one piston assembly end serving as a piston actuating means, a second smaller diameter elongated piston rod at the opposite end closely received inside said second small bore portion with second seal serving as a concentrate displacement piston and a third intermediate diameter piston portion interconnecting the innermost ends of said first and second piston assembly ends closely received inside said third bore portion serving as a diluent displacement piston when said piston assembly is shifted inside said housing bore from said first fluid suction position to said second fluid discharge position, said position change accomplished by a fluid pressure action over said large piston entering said actuating means via at least two fluid supply ports from a source housing a pressurized working fluid selectively delivered to said piston actuating means at said large size actuating bore end through a first port in said end wall provided with a valving means capable of alternating communication with said source to initiate a fluid operable means by pressure loading of a first larger face said piston provides initiating said piston shifting from said first suction position to said second discharge position and subsequently disconnecting said fluid communication with said source by valve exhaust through said first port while allowing pressure loading of a second smaller side said piston provides by said working fluid constantly communicating therewith through a second port of said piston actuating means entering said large size actuating bore end adjacent said first shoulder urging an automatic return of said piston assembly into the first normally occuring suction position when said second port is in constant communication with the source of said working fluid and said valve is open to exhaust until said valving means become reset repeating the cycle with subsequent pumping and discharge of diluent mixed with concentrate in proportion desired from said pumping end of the diluter.

6. A diluter as in claim 5 including volumetric adjustment means of said discharge contents from said diluter to provide various ratios of concentrate vs. diluent, said adjustment means including a telescoping piston-rod assembly for varying displacement.

7. A diluter as in claim 5 wherein said valving means for porting fluid includes a three-way directional valve disposed generally at said actuating end of said diluter.

* * * * *